US007582066B2

(12) United States Patent
Shimotori

(10) Patent No.: US 7,582,066 B2
(45) Date of Patent: Sep. 1, 2009

(54) NEUROLOGICAL DISEASE PREVENTION APPARATUS THROUGH SOUND WAVE VIBRATION

(76) Inventor: Yoshio Shimotori, 2-264, Kamiyama-cho, Funabashi-shi, Chiba (JP) 273-0046

( * ) Notice: Subject to any disclaimer, the term of this patent is extended or adjusted under 35 U.S.C. 154(b) by 0 days.

(21) Appl. No.: 12/113,318

(22) Filed: May 1, 2008

(65) Prior Publication Data

US 2008/0275372 A1 Nov. 6, 2008

(30) Foreign Application Priority Data

May 2, 2007 (JP) ..... 2007-121797
Mar. 27, 2008 (JP) ..... 2008-084903

(51) Int. Cl.
*A61H 23/02* (2006.01)
*A61H 1/00* (2006.01)

(52) U.S. Cl. ..... 601/47; 601/48

(58) Field of Classification Search ..... 601/2, 601/15, 46, 47, 48, 49, 70, 71, 79; 600/15
See application file for complete search history.

(56) References Cited

U.S. PATENT DOCUMENTS 5,421,799 A * 6/1995 Rabin et al. ..... 601/71
5,486,156 A * 1/1996 Takach ..... 601/70
5,611,771 A * 3/1997 Taylor ..... 601/70
5,928,262 A * 7/1999 Harber ..... 606/204.35
6,537,229 B1 * 3/2003 Wang ..... 600/508
6,554,787 B1 * 4/2003 Griffin et al. ..... 602/74
2005/0256433 A1 * 11/2005 Lin ..... 601/70
2006/0142675 A1 * 6/2006 Sargent ..... 601/70
2007/0149905 A1 * 6/2007 Hanna ..... 601/79
2008/0021354 A1 * 1/2008 Ostrov ..... 601/70

FOREIGN PATENT DOCUMENTS

JP 05-21940 U 3/1993
JP 05-123373 A 5/1993
JP 06-285129 A 10/1994
JP 09-285512 A 11/1997
JP 2000-102580 A 4/2000
JP 2004-173711 A 6/2004
JP 2005-348994 A 12/2005
JP 3121595 U 4/2006

* cited by examiner

*Primary Examiner*—Danton DeMille
(74) *Attorney, Agent, or Firm*—Darby & Darby P.C.

(57) ABSTRACT

By the combined use of ultrasonic vibration generated by a pair of ultrasonic vibrators that are alternately driven asynchronously with the heartbeat, and stereo music vibration waves generated by a pair of music vibrators, the brain is gently and effectively provided with massage without subjecting the head to excessive massage. Blood flow can be stimulated deep within the brain. As the rise and fall of the vibration energy generated by the ultrasonic vibrators are mitigated by the modulators, impact applied by the vibration to the head of the wearer is reduced.

10 Claims, 7 Drawing Sheets

NEUROLOGICAL DISEASE PREVENTION APPARATUS THROUGH SOUND WAVE VIBRATION

INCORPORATION BY REFERENCE

The present application claims priority under 35 U.S.C. §119 to Japanese Patent Application Nos. 2007-121797 filed on May 2, 2007 and 2008-084903 filed on Mar. 27, 2008. The content of the application is incorporated herein by reference in their entirety.

FIELD OF THE INVENTION

The present invention relates to an ultrasonic apparatus for stimulating cephalic blood flow to prevent neurological diseases that cause cognitive disorders such as dementia, which is an acquired neurological disorder. In Japan, 1.7 million people are presently afflicted with such disorders, with fears that this number will increase to 2.5 million in 10 years. With regard to disorders of this type, the World Health Organization (WHO) reports that there are presently 24.4 million patients in the world afflicted with dementia-type disorders and that this number will increase to 44.4 million in 20 years. At present, however, no effective preventive measure has been found. Treatment relies on rehabilitation and medication after the onset of symptoms, but the effectiveness of such treatment has been negligible. In response to this situation, the present invention provides a head massage apparatus that uses ultrasonic waves rather than medication and is effective for prevention of as well as rehabilitation for such disorders.

BACKGROUND OF THE INVENTION

A typical example of the aforementioned neurological disorders is dementia, which is the result of causes that are broadly categorized as Alzheimer's disease, vascular dementia, and Parkinson's disease. Pathologically, damage from Alzheimer's disease characteristically begins in the hippocampus, which is the memory cortex, and spreads until atrophy is seen over the entire brain. Vascular dementia is caused by cerebrovascular disease and its symptoms include impairment of mobility and of intellectual functions. A distinctive feature of vascular dementia is said to be the occurrence of "patchy mental impairment." There are also cases of "mixed dementia," in which both Alzheimer's disease and vascular dementia are observed. Furthermore, dementia with Levy bodies (DLB), a form of dementia referred to as the third type of dementia, has been identified, in which many small gangrenous areas form inside the brain. One of major causes of these diseases is impaired cerebral blood flow resulting in insufficient supply of oxygen and nutrition to brain cells, leading to the death of cerebral nerve cells. Conventional art make use of medication, which are accompanied by some form of side effect yet virtually none have proven to be effective. An object of the present invention is to provide a means of promoting blood flow without relying on medication.

People hope to live out their lives with dignity. However, should people suffer from a cognitive disorder such as dementia when they grow older, they become prone to erratic behavior as a result of damage caused to their brain, and many of these elderly people themselves become victims of abuse due to reactions to their behavior. People afflicted with dementia occupy 10% of Japan's total population of people who are 60 years of age or over, and many face the possibility of elderly abuse. On the other hand, the significant financial and psychological burdens imposed on the family members of an afflicted person are becoming a serious social issue throughout developed countries. There are many types of treatments that utilize massage; however, massages to the brain via the head are not currently being carried out.

Related conventional art is described hereunder. Included among disorders associated with neurological diseases is depression. In a competitive society, the work environment can be quite harsh, with high levels of psychological stress resulting from severe competition between companies and very busy work-related duties. If people suffering from migraines are included, the number of patients afflicted with some form of neurological disease would be extremely large. As a conventional art, muscle massage using mechanical vibration or massage using oil applied to the surface of the body is currently carried out. However, massage conducted by applying a stimulus to the brain inside the head has not been practiced.

Among the very few references to the conventional art are descriptions by the inventor of the present invention of the general direction of the early stages of this technology in a patent application (Japanese laid-open Patent Publication No. 2005-348994) and a utility model (Japanese Utility Model Registration No. 3121595). These were model inventions, and their essential technologies were still under research and development. The present invention discloses the essence of the technologies of these related inventions. In other words, the claims of the present invention are what are widely called Jepson claims, with the parts disclosing models in the above mentioned related art as a prerequisite. This is the relationship between the related art and the present invention.

Examples of possible means to massage the brain by applying external stimuli include massage by mechanical vibration and massage using electrical stimuli. Mechanical massage is conducted by applying weak vibration from a vibrator to the head of a subject. However, this method presents a problem in that such treatment can be provided only by a skilled person, resulting in high personnel cost. Giving electrical stimuli presents a serious problem of being potentially harmful to a subject in that electrical stimuli may cause loss of memory, resulting in the possible acceleration of dementia. Therefore, in order to prevent neurological diseases, there exists a need for a safe and effective means that any ordinary person can easily operate. Therefore, an object of the invention is to provide a cognitive disorder prevention/rehabilitation apparatus to which a ceramic vibrating module that primarily uses ultrasonic waves and developed to be small and light-weight and capable of being fitted to an ordinary cap or hairband is applied, thereby preventing as best as possible the advance of these malignant disorders, and promoting the well-being of numerous people.

SUMMARY OF THE INVENTION

In an aspect of the present invention, a neurological disease prevention apparatus comprises a pair of first vibrators for generating sound wave vibration, and a pair of second vibrators for generating sound wave vibration from music so that vibration generated by the first vibrators and the second vibrators is applied via the scalp through the skull to blood vessels in the brain of a person wearing the neurological disease prevention apparatus, thereby promoting cerebral blood flow to invigorate cerebral functions, wherein the neurological disease prevention apparatus further includes a modulating means for mitigating the rise and fall of vibration energy generated by the first vibrators; the first vibrators are alternately driven asynchronously with the heartbeat of the person wearing the neurological disease prevention apparatus; and the second vibrators provide stereo vibration waves. By the combined use of sound wave vibration generated by the pair of first vibrators that are alternately driven asynchronously with the heartbeat, and stereo music vibration waves generated by the pair of second vibrators, the brain is gently and effectively provided with massage without being subjected to excessive massage so that blood flow can be stimulated deep within the brain. As the rise and fall of the vibration energy generated by the first vibrators are mitigated by the modulating means, impact applied by the vibration to the head of the person wearing the neurological disease prevention apparatus is reduced.

In another aspect of the present invention, the first vibrators are adapted to generate ultrasonic vibration in the range of 20 kHz to 200 kHz. By generating ultrasonic vibration in the range of 20 kHz to 200 kHz by means of the first vibrators, the apparatus of the present invention is capable of providing effective cerebral massage with a minimal vibration energy that imposes little burden on the human body.

In another aspect of the present invention, the first vibrators are respectively fitted to the right side and the left side of the frontal part of the head of the person wearing the neurological disease prevention apparatus, and the second vibrators are respectively fitted to the right and left temporal areas. With the configuration as above, as the first vibrators are in close contact with the right and left sides of the frontal part of the head, the first vibrators are capable of effectively transmitting vibration without being obstructed by the hair of the person wearing the neurological disease prevention apparatus. As the second vibrators are respectively fitted to the right and left temporal areas, in the proximity of the auditory nerves, the second vibrators are capable of transmitting vibration sufficiently well even if the second vibrators are not firmly fitted to the head. In another aspect of the present invention, each second vibrator includes a vibrator main body and a vibrating cone. The vibrator main body serves to generate sound wave vibration from music containing an ample quantity of high frequency components. The vibrating cone is attached to the vibrator main body and capable of following the shape of and snugly fitting to the head. Because the vibrator main bodies provide audio stimuli and soothing stimuli by generating sound wave vibration from music that contains an ample quantity of high frequency components, massage effectiveness is improved. Furthermore, as the vibrating cones, which are capable of following the shape of and snugly fitting to the head, are respectively attached the vibrator main bodies, vibration generated by the vibrator main bodies is reliably transmitted to the head.

In another aspect of the present invention, the neurological disease prevention apparatus further includes a music control means and a control means. The music control means serves to store therein a plurality of music pieces that can be output from the second vibrators. The control means serves to cause the first vibrators and the second vibrators to generate vibration regularly at a prescribed time of day. With the configuration as above, generating regularly at a prescribed time of day sound wave vibration by means of the first vibrators and vibration from a plurality of music pieces stored in the music control means by means of the second vibrators, effectiveness of massage can be further improved.

In another aspect of the present invention, the music pieces stored in the music control means include at least a group of Mozart's works consisting of Serenade No. 3 in G Major, K 525 (Eine Kliene Nachtmusik), the first movement of Divertimento No. 1 in D Major, K 136, and No. 3 in B flat Major from 12 German Dances, K 586. Therefore, by storing in the music control means at least the following three works by Mozart, Serenade No. 3 in G Major, K 525 (Eine Kliene Nachtmusik) and the first movement of Divertimento No. 1 in D Major, K 136, both of which are believed to be effective in preventing neurological diseases, as well as No. 3 in B flat Major from 12 German Dances, K 586, which is believed to be effective in preventing blood circulatory diseases, and generating these music pieces as sound wave vibration by means of the second vibrators, effective massage of the brain can be provided.

In another aspect of the present invention, the neurological disease prevention apparatus further includes a wearable unit to be fitted on the head, and snap buttons for attaching the first vibrators and the second vibrators to the inner side of the wearable unit. Therefore, by attaching the first vibrators and the second vibrators to the inner side of the wearable unit by means of the snap buttons, the first vibrators and the second vibrators can easily be fitted to the head via the wearable unit, and the neurological disease prevention apparatus can be given a slim shape.

DETAILED DESCRIPTION OF THE PREFERRED EMBODIMENTS

Next, a first embodiment of the present invention is explained in detail hereunder, referring to FIGS. 1 to 7. The basic logic and structure of this embodiment is in accordance with Ultrasonic Massage System disclosed in Japanese Laid-open Patent Publication No. 2005-348994 and Bone Conduction Massage Apparatus disclosed in Japanese Utility Model Registration No. 3121595, both of which serve as the basic technology of the present embodiment.

Figure 1:
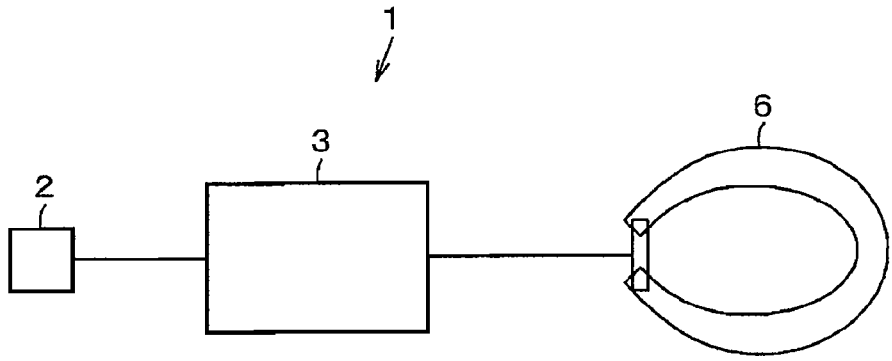
FIG. 1 is a block diagram of a neurological disease prevention apparatus according to a first embodiment of the present invention.

As shown in FIG. 1, a neurological disease prevention apparatus 1 includes an AC adaptor power supply 2, a control unit 3, and a cap-shaped headset 6 serving as a wearable unit. The neurological disease prevention apparatus 1 is used to massage the brain and promote good health for the brain. The AC adaptor power supply 2 is adapted to be connected to a commercial power supply. The control unit 3 is adapted to be connected to the AC adaptor power supply 2 and receive supply of DC current that has been transformed from commercial power by the AC adaptor power supply 2. The headset 6 is provided with ultrasonic vibrators 4 and music vibrators 5. The ultrasonic vibrators 4 are sound wave vibrators and serve as first vibrators, and the music vibrators 5 serve as second vibrators. These vibrators 4,5 are adapted to receive vibration energy from the control unit 3 and removably attached to the inner side of the headset 6. Power may be supplied from other means, such as a battery or batteries, in place of the AC adaptor power supply 2.

Figure 2:
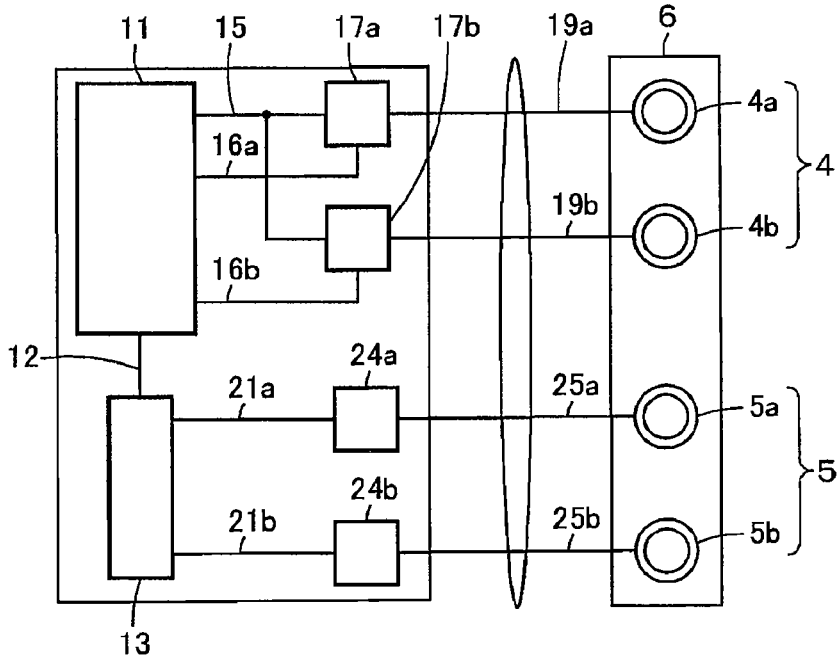
FIG. 2 is a control signal system diagram of the neurological disease prevention apparatus.
Figure 3A:
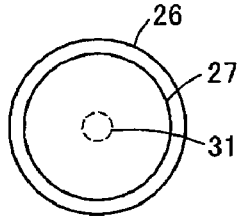
FIGS. 3(*a*)-(*f*) are structural diagrams of a vibrator of the neurological disease prevention apparatus.
Figure 3B:
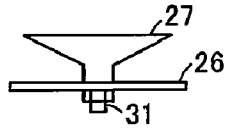
Figure 3C:
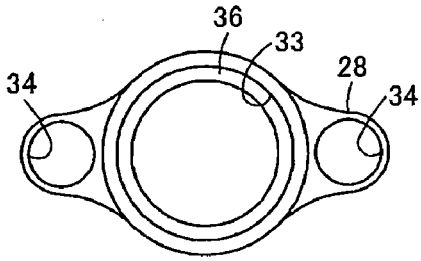
Figure 3D:
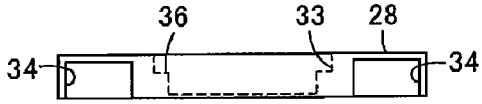
Figure 3E:
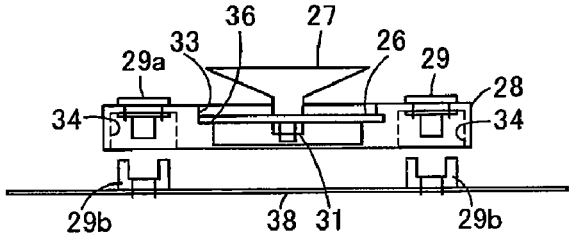
Figure 3F:
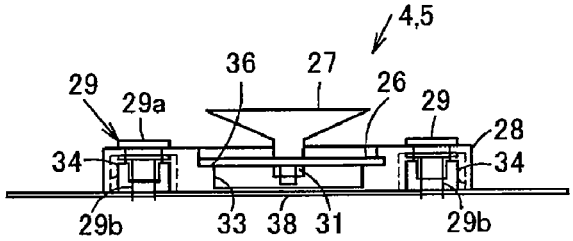

As shown in FIG. 2, the control unit 3 includes a microprocessor module 11, which serves as a control means, and a music control module 13, which serves as a music control means and is connected to the microprocessor module 11 through a music control signal line 12.

The microprocessor module 11 serves to control vibration for a prescribed period of time (e.g. ultrasonic vibration for 10 minutes and music vibration for 12 minutes) as well as create a specific rhythm for generating these vibrations. In other words, a daily cycle can be established in which generation of these vibrations is activated manually or automatically at any desired time of day, for example, in the morning, afternoon, and evening. The microprocessor module 11 is connected through an ultrasonic signal line 15 and ultrasonic drive signal lines 16*a*,16*b* to modulators 17*a*,17*b*, which serve as a modulating means. The microprocessor module 11 is capable of outputting a carrier wave through the ultrasonic signal line 15 to the modulators 17*a*,17*b*; modulating the carrier wave by a signal wave W1 (shown in FIG. 5) generated at the modulators 17*a*,17*b*, which are controlled by the microprocessor module 11 through the ultrasonic drive signal lines 16*a*,16*b*, so as to mitigate rising and trailing edges of the carrier wave and thereby obtain drive signals 18*a*,18*b* (shown in FIG. 6(*b*)), and feeding these signals 18*a*,18*b* respectively to the ultrasonic vibrators 4*a*,4*b* through vibrator connecting cables 19*a*,19*b*. A carrier wave is ultrasonic vibration energy with a wavelength that ranges, for example, from 20 kHz to 200 kHz (preferably around 30 kHz) and will become long-wavelength vibration inside the human body. Output from the ultrasonic vibrators 4*a*,4*b* can be set externally by means of a level switch (not shown) that serves as a first output-adjusting means. The microprocessor module 11 also controls the energy source of the vibrators of the neurological disease prevention apparatus 1 by using a timer or other appropriate means.

The signal wave W1 is formed in a smooth bell-shaped curve having no change points. The output gradually increases from 0V, with the inclination, i.e. the increasing rate, becoming gradually steeper. Thereafter, as the output voltage approaches its maximum point, the inclination gradually becomes less steep; after reaching the maximum point, the output gradually decreases, with the inclination becoming gradually steeper; and thereafter, the inclination gradually flattens out until the voltage gradually decreases to 0V.

A plurality of prescribed music pieces may be stored in the music control module 13 beforehand. Functions of the music control module 13, such as selection and repetition of music pieces, are controlled with signals generated by the microprocessor module 11 transmitted to the music control module 13 through the music control signal line 12. Audio signals output from the music control module 13 are transmitted through audio signal lines 21*a*,21*b* to and amplified by music drive circuits 24*a*,24*b*, which serve as an amplifying means. The amplified audio signals are then fed through vibrator connecting cables 25*a*,25*b* to the music vibrators 5*a*,5*b*.

It is desirable for music pieces stored in the music control module 13 to contain an ample quantity of high frequency components that include audio stimuli and soothing stimuli for promoting blood flow. Examples of such music pieces include various works by Mozart, such as Serenade No. 3 in G Major, K 525 (Eine Kliene Nachtmusik) and the first movement of Divertimento No. 1 in D Major, K 136, both of which are believed to be effective in preventing neurological diseases, as well as No. 3 in B flat Major from 12 German Dances, K 586 which is believed to be effective in preventing blood circulatory diseases.

Output from the music vibrators 5*a*,5*b* can be set externally by means of a volume control (not shown) that serves as a second output-adjusting means.

Instead of storing music pieces in the music control module 13, an external sound source, such as a music player or a portable music device, may be connected to the neurological disease prevention apparatus 1 so that any audio signals can be fed from the external sound source to the music vibrators 5*a*,5*b* through the music drive circuits 24*a*,24*b*.

As shown in FIG. 3(*a*) to FIG. 3(*f*), each vibrator 4,5 has a vibrator main body, which may be, for example, a bimorph piezoelectric ceramic vibrator 26, and a vibrating cone 27 attached to the piezoelectric ceramic vibrator 26. Each vibrator 4,5 is supported by a vibrator holder 28, which is removably attached to the headset 6 by means of snap buttons 29.

Each bimorph piezoelectric ceramic vibrator 26 is formed of a base electrode, which is disposed in the middle, and ceramic members sandwiching and being bonded to the base electrode. When an AC voltage is applied between the electrode and these ceramic members, dynamic distortion in proportion to the applied voltage is generated in the vertical directions, causing vibration of the piezoelectric ceramic vibrator 26. This is a widely known electrical and mechanical phenomenon.

The vibrating cone 27 of each vibrator 4,5 is fastened to the approximate center of the piezoelectric ceramic vibrator 26 with a screw 31 or any other appropriate means, which is inserted through the backside of the vibrating cone 27. Each vibrating cone 27 is formed flexibly so that it can be bent and snugly fitted to the head of the wearer, i.e. the person wearing the neurological disease prevention apparatus 1. The rim of each piezoelectric ceramic vibrator 26 is secured by means of an adhesive agent so that substantial distortion is generated at the central part of the piezoelectric ceramic vibrator 26 and transmitted to the vibrating cone 27.

Each vibrator holder 28 is formed of a flexible member, such as rubber, in a thin, plate-like shape and provided with a circular fitting hole 33 formed at the central part of the vibrator holder 28, and button fitting holes 34,34 flanking the fitting hole 33. Each fitting hole 33 is provided so that a vibrator 4,5 may be fitted therein, and the button fitting holes 34,34 are adapted to respectively receive the snap buttons 29.

Each fitting hole 33 is provided with a bonding surface 36, which is a step-like flat surface extending at an approximately right angle along the entire inner rim of the fitting hole 33, so that the rim of the corresponding piezoelectric ceramic vibrator 26 can be fixed to the bonding surface 36 with an adhesive agent or by other appropriate means.

Each button fitting hole 34 is formed so that the male member 29*a* of a snap button 29 can be fitted therein from the front side and, when being in the fitted position, the male member 29*a* does not protrude from the vibrator holder 28. By snugly fitting the male members 29*a* of the snap buttons 29 respectively in the female members 29*b*, which are attached to a base fabric 38 on the inner side of the headset 6, the vibrators 4,5 can be removably attached to the inner side of the headset 6 via the vibrator holders 28. As a result of this configuration, it has become possible to reduce the thickness of the apparatus to a minimum in the state where the vibrators 4,5 are attached to the base fabric 38 via the vibrator holders 28 as shown in FIG. 3(*f*).

Figure 4A:
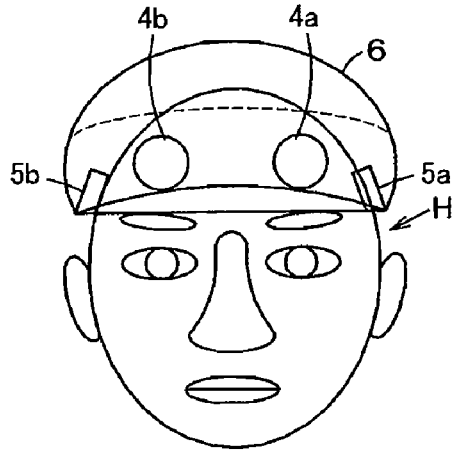
FIGS. 4(*a*) and (*b*) are arrangement diagrams showing how the vibrators of the neurological disease prevention apparatus are arranged.
Figure 4B:
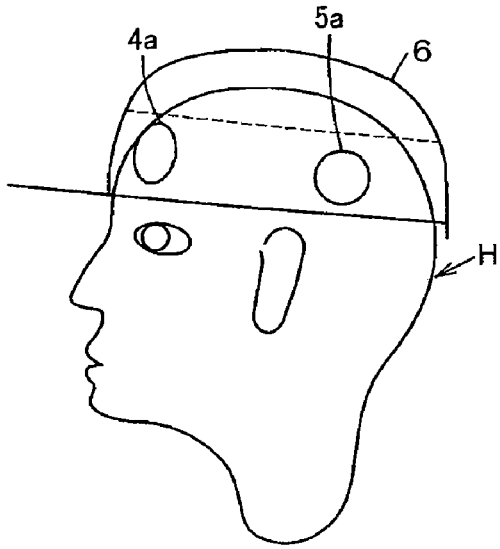
Figure 5A:
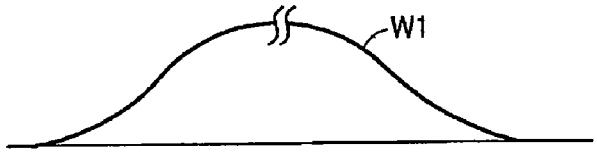
FIGS. 5(*a*)-(*f*) are waveform charts of modulated signals of the neurological disease prevention apparatus.
Figure 5B:
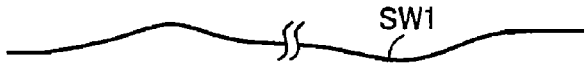
Figure 5C:
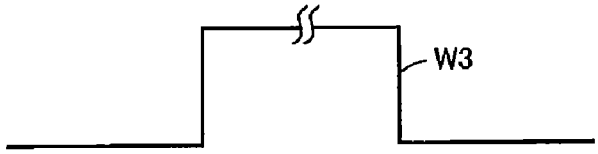
Figure 5D:
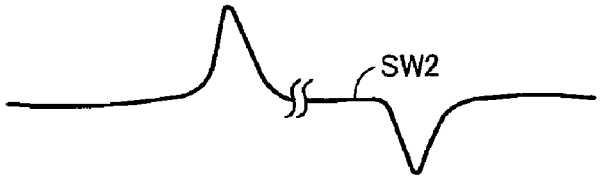
Figure 5E:
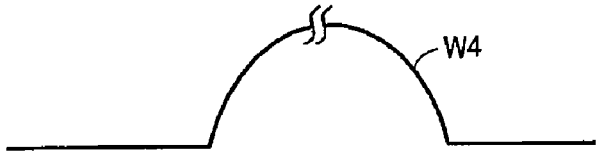
Figure 5F:
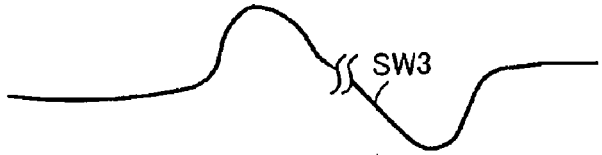
Figure 7:
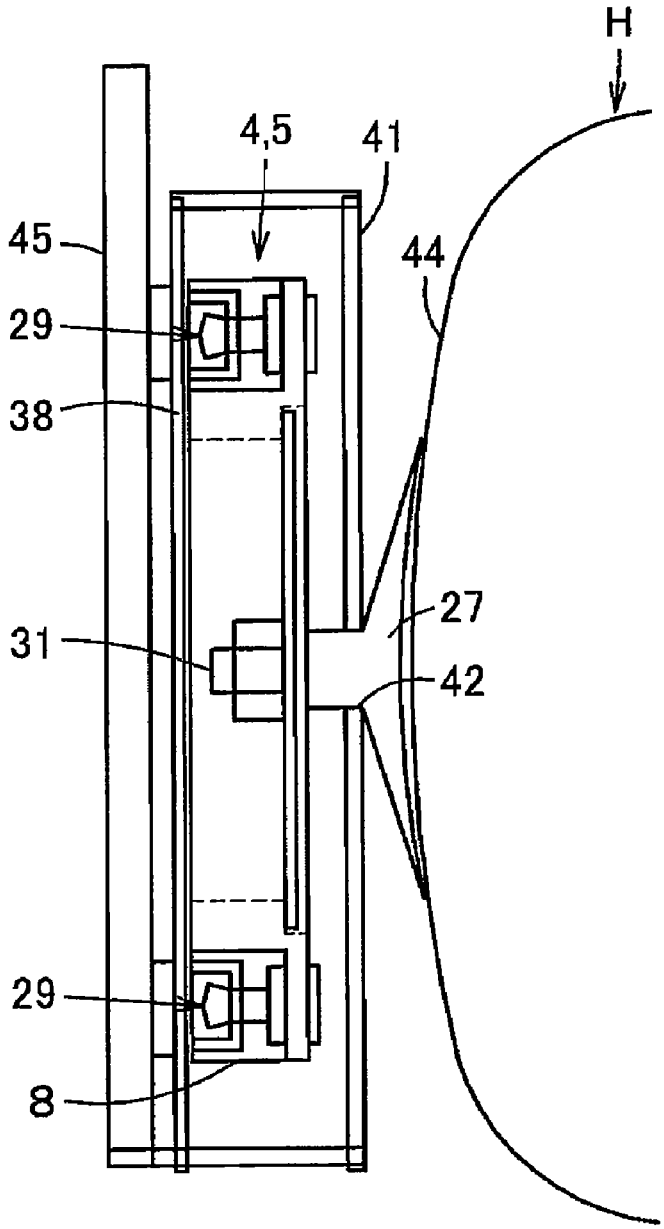
FIG. 7 is a schematic drawing showing how a vibrator of the neurological disease prevention apparatus is in contact with the head.

As shown in FIG. 4(*a*), FIG. 4(*b*), and FIG. 7, the headset 6 has a shape resembling an ordinary cap or a sun visor. The vibrators 4,5 are arranged on the inner side of the headset 6 in such a manner that the ultrasonic vibrators 4*a*,4*b* can be respectively secured to the left side and the right side of the frontal part of the head of the wearer H and that the music vibrators 5*a*,5*b* can be respectively secured to the left and right temporal areas of the wearer H. The headset 6 has an inner band 41 that has sweat absorbing/dissipating properties and serves as a sweatband. The inner band 41 is provided with button passage holes 42 from which the respective vibrating cones 27 can be exposed to the inner space of the headset 6. In this state, the vibrating cone 27 of each vibrator 4,5 follows the curve of and snugly fits to the corresponding superficial part 44 of a human head as shown in FIG. 7. The outer surface of the headset 6 is covered by a headset outer fabric 45.

With the configuration as above, the ultrasonic vibrators 4 are capable of effectively transmitting vibration through their respective vibrating cones 27, which are in close contact with the right and left sides of the frontal part of the wearer's head without being obstructed by the wearer's hair. As the music vibrators 5 are in the proximity of the auditory nerves, the music vibrators 5 are capable of transmitting vibration sufficiently well even if the music vibrators 5 are not firmly fitted to the head.

Next, the functions of the first embodiment described above are explained.

When the wearer H wears the headset 6 on his/her head at a prescribed time of day, such as in the morning, afternoon, or evening, the vibrating cones 27 of the ultrasonic vibrators 4*a*,4*b* come into close contact with the superficial parts 44 at the right and left sides of the frontal part of the wearer H's head respectively, and the vibrating cones 27 of the music vibrators 5*a*,5*b* come into close contact with each respective superficial part 44 at the right and left temporal areas of the wearer H.

In this state, the microprocessor module 11 of the control unit 3, which is driven by electric power fed from the AC adaptor power supply 2, feeds to the head of the wearer H ultrasonic vibration from the ultrasonic vibrators 4 for 10 minutes, for example, and music vibration from the music vibrators 5 for 12 minutes, for example.

Figure 6A:
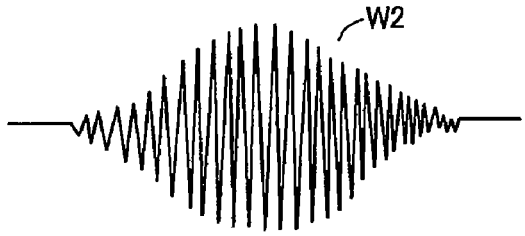
FIGS. 6(*a*)-(*c*) are waveform charts representing vibration waveforms of the neurological disease prevention apparatus.
Figure 6B:
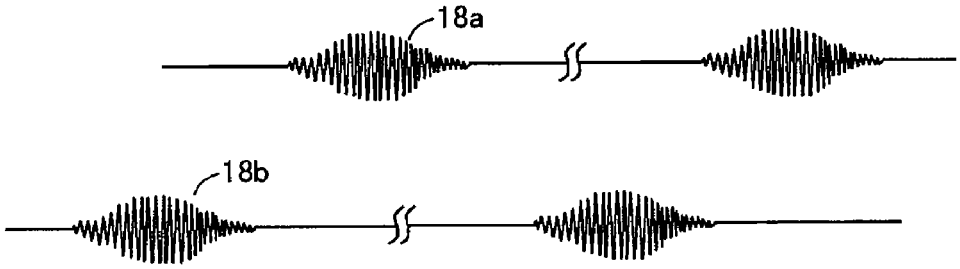
Figure 6C:
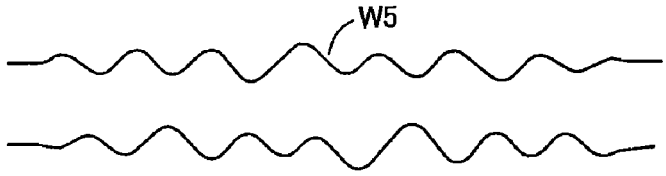

When ultrasonic vibration is being generated, a carrier wave that is an ultrasonic signal output from the microprocessor module 11 to the modulators 17*a*,17*b* through the ultrasonic signal line 15 is modulated by a signal wave W1 (shown in FIG. 5(*a*)), which is a modulating wave generated by each modulator 17*a*,17*b*, so that the carrier wave is modulated into a modulated wave W2 with mitigated rising and trailing edges as shown in FIG. 6(*a*). For example, in case of modulation by a rectangular modulating wave W3 shown in FIG. 5(*c*), a shock wave SW2 in the shape of a large rectangular wave as shown in FIG. 5(*d*) is generated at each change point of the modulating wave W3. In case of modulation by a sinusoidal modulating wave W4 shown in FIG. 5(*e*), a sinusoidal shock wave SW3 shown in FIG. 5(*f*) is generated. These shock waves may give strong sense of discomfort to the human body. However, the shock wave SW1 (shown in FIG. 5(*b*)) resulting from the signal wave W1 is relatively weak so that although it is felt, it will not give much discomfort to the wearer H. The mitigated modulated waves W2 are fed as drive signals 18*a*,18*b* to the ultrasonic vibrators 4*a*,4*b* to drive the ultrasonic vibrators 4*a*,4*b* alternately for a prescribed period of time (e.g. for 0.1 second) at given intervals (e.g. at 1.5-second intervals) so that the ultrasonic vibrators 4*a*,4*b* output ultrasonic vibration waves to massage the head of the wearer H. The output frequency of the ultrasonic vibration waves may desirably be set so as to be asynchronous with the heartbeat of the wearer H.

When music vibration is being generated, the microprocessor module 11 controls the music control module 13 through the music control signal line 12 so that a prescribed music piece is selected from the pieces stored in the music control module 13; signals representing the selected music are amplified by the music drive circuits 24*a*,24*b* through the audio signal lines 21*a*,21*b*, and, thereafter, output as music vibration waves, i.e. stereo signal waves W5 shown in FIG. 6(*c*), from the music vibrators 5*a*,5*b* to massage the head of the wearer H. The music pieces stored in the music control module 13 may be sequentially output.

The output of these ultrasonic vibration or music vibration is individually set at a desired level by the wearer H or other operator by means of a level switch, a volume control, or the like.

When a prescribed time period elapses, massage is terminated. This termination may be conducted by terminating supply of electric power from the AC adaptor power supply 2, outputting a termination signal from the microprocessor module 11, or terminating output of control signals from the microprocessor module 11. The duration of massage may be set beforehand by using a timer or other appropriate means. The wearer H or other operator may set the duration for a desired time period or terminate the apparatus manually when a desired time period has elapsed.

Next, effects of the first embodiment described above are explained.

Ultrasonic vibration generated by the ultrasonic vibrators 4 are capable of gently massaging the brain. Furthermore, mitigating the rise and fall of the vibration energy of the ultrasonic vibration by means of the modulators 17*a*,17*b* mitigates impact applied by the vibration to the head.

Limiting vibration generated by the ultrasonic vibrators 4 to ultrasonic vibration that has a wavelength in the range of 20 kHz to 200 kHz and will become long-wavelength vibration inside the human body enables effective massage of the brain with a minimal vibration energy. For example, approximately 1 mW of electric power, which imposes little burden on the human body, is sufficient for providing effective massage to the interior of the brain.

Providing the music vibrators 5 for generating sound wave vibration from music and using these music vibrators 5 together with the ultrasonic vibrators 4 enables more effective brain massage.

Furthermore, by fitting the ultrasonic vibrators 4*a*,4*b* respectively to the right side and the left side of the frontal part of the head and alternately driving these ultrasonic vibrators 4*a*,4*b* asynchronously with the heartbeat, excessive massage can be prevented. Furthermore, by using the ultrasonic vibrators 4*a*,4*b* in combination with stereo vibration waves from the music vibrators 5*a*,5*b* fitted to the right and left temporal areas, it is possible to stimulate blood flow deep within the brain.

The music vibrators 5 improve massage effectiveness, because they provide audio stimuli and soothing stimuli by generating, by means of the piezoelectric ceramic vibrators 26, sound wave vibration from music that contains an ample quantity of high frequency components. Furthermore, as the vibrating cones 27, which follow the shape of and snugly fits to the head, are respectively attached to the piezoelectric ceramic vibrators 26, vibration generated by the piezoelectric ceramic vibrators 26 is reliably transmitted to the head.

By generating regularly at a prescribed time of day, such as in the morning, afternoon, or evening, ultrasonic vibration by means of the ultrasonic vibrators 4 and vibration from a plurality of music pieces stored in the music control module 13 by means of the music vibrators 5, effectiveness of massage can be further improved.

According to the present embodiment, the music pieces stored in the music control module 13 include at least the following three works by Mozart, Serenade No. 3 in G Major, K 525 (Eine Kliene Nachtmusik) and the first movement of Divertimento No. 1 in D Major, K 136, both of which are believed to be effective in preventing neurological diseases, as well as No. 3 in B flat Major from 12 German Dances, K 586, which is believed to be effective in preventing blood circulatory diseases. Therefore, by generating these music pieces as sound wave vibration by means of the music vibrators 5, effective massage of the brain can be provided.

To be more specific, storing and using the aforementioned Mozart music pieces respectively in a morning setting, an afternoon setting, and an evening setting to form a daily cycle provides a sufficient massage effect.

Therefore, receiving a gentle massage of the brain by ultrasonic waves while listening to Mozart's music, which provides a highly soothing effect and massages the brain through the temporal areas via bone conduction, encourages such benefits as an increase of alpha brain waves, reduction of saliva amylase activity, which is regarded as an indicator of stress and fatigue, lower blood pressure, and lower heart rate.

Furthermore, giving ultrasonic massaging vibration from the right side and the left side of the frontal part of the head is effective in stimulating blood flow deep within the brain.

When blood flow is reduced at a part of the brain as a result of an imbalance in nerve activities, or there is uneven cerebral blood flow distribution, giving ultrasonic massage to the brain enables stable distribution of blood flow throughout the brain and has a remarkable effect on maintaining a healthy brain.

Furthermore, as massage via bone conduction is transmitted throughout the entire head, the regions underneath the face are massaged, facilitating blood flow with an effectiveness equivalent to massaging the surface of the face.

People, especially women, become increasingly prone to osteoporosis as they age. Ultrasonic massage to the skull or the face has a profound effect in dealing with osteoporosis.

As the vibrators 4,5 are attached to the inner side of the headset 6 via the snap buttons 29, the present embodiment described above enables the vibrators 4,5 to be fitted to the head easily. In addition, because the neurological disease prevention apparatus 1 has been given a slim shape, wearing the neurological disease prevention apparatus 1 does not adversely affect the appearance of the wearer H, and the burden of the weight of the neurological disease prevention apparatus 1 on the wearer H is reduced.

The cap-like shape of the headset 6 reduces any feeling of discomfort when being worn and can make it more user-friendly.

Figure 8A:
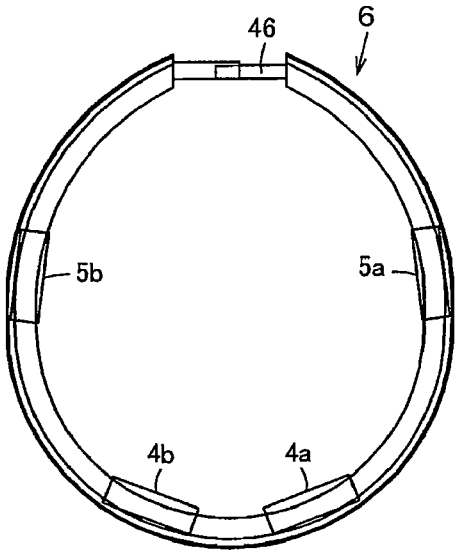
FIGS. 8(*a*)-(*c*) are arrangement diagrams showing how the vibrators of a neurological disease prevention apparatus according to a second embodiment of the present invention are arranged.
Figure 8C:
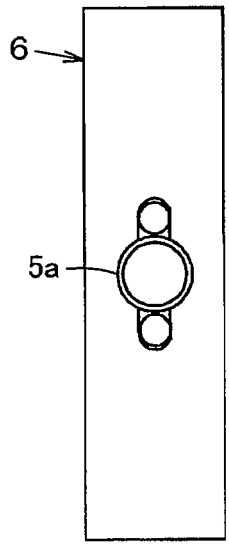
Figure 8B:
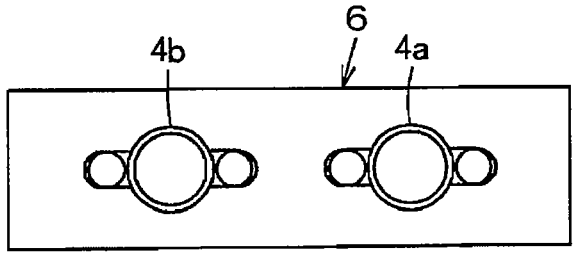

Instead of the shape of the first embodiment described above, the headset 6 may be formed in the shape of a hairband as in the case of the second embodiment of the invention shown in FIG. 8(*a*) to FIG. 8(*c*). If such is the case, the headset 6 has a three-layer configuration, with the vibrators 4,5 arranged and attached to the inner side so that the ultrasonic vibrators 4*a*,4*b* are respectively located at the two lateral sides of the frontal part of the head and that the music vibrators 5*a*,5*b* are respectively located at the two temporal areas when the headset 6 is worn. As the headset 6 is a one-size-fits-all and can be supported by means of a hook-and-loop fastener 46 (what is widely called a Velcro Tape®) in order to fit the outer diameter of the head of the wearer, the headset 6 according to this embodiment is even more convenient to use.

In any one of the embodiments described above, the first vibrators may be designed to output vibration of audible sound. In other words, sound waves generated by the first vibrators must be ultrasonic and/or audible sound waves, or, in an alternative configuration, a single vibrator may function as both a first vibrator and a second vibrator.

An apparatus of the present invention is a healthcare appliance, and its application is not limited to prevention and rehabilitation of neurological diseases of elderly people; the apparatus is also useful and effective in relieving fatigue of people still active in the working world. Furthermore, the apparatus may also be used by children, with the appropriate strength of massage being determined and selected by a parent or guardian. If used in such a manner, the apparatus is capable of promoting the blood flow in the brain and thereby relieving fatigue attributed to studies or other causes. Therefore, the apparatus of the present invention has tremendous potential as a household healthcare appliance, and is capable of generating a positive economic effect in the industrial field by creating a broad range of markets.

What is claimed is:

1. A neurological disease prevention apparatus comprising a pair of first vibrators for generating sound wave vibration, and a pair of second vibrators for generating sound wave vibration from music so that vibration generated by the first vibrators and the second vibrators is applied via the scalp through the skull to blood vessels in the brain of a person wearing the neurological disease prevention apparatus, thereby promoting cerebral blood flow to invigorate cerebral functions, wherein:

the neurological disease prevention apparatus further includes a modulating means for mitigating a rise and fall of pulse vibration energy generated by the first vibrators;

each one of the pair of first vibrators is respectively fitted to one of the right side and the left side of the head of the person wearing the neurological disease prevention apparatus, and is alternately driven with the other first vibrator and asynchronously with the heartbeat of the person wearing the neurological disease prevention apparatus, wherein each first vibrator generates successive output pulses of the pulse vibration energy at nearly identical intervals so that an output period for an output pulse from one first vibrator does not overlap with an output period for an output pulse from the other first vibrator; and each of the pair of second vibrators is respectively fitted to one of the right side and the left side of the head, the pair of second vibrators providing stereo vibration waves.

2. A neurological disease prevention apparatus as claimed in claim 1, wherein:

the first vibrators are adapted to generate ultrasonic vibration in the range of 20 kHz to 200 kHz.

3. A neurological disease prevention apparatus as claimed in claim 1, wherein:

the first vibrators are respectively fitted to the right side and the left side of the frontal part of the head of the person wearing the neurological disease prevention apparatus; and the second vibrators are respectively fitted to the right and left temporal areas.

4. A neurological disease prevention apparatus as claimed in claim 1, wherein each second vibrator comprises:

a vibrator main body for generating sound wave vibration from music that contains an ample quantity of high frequency components; and a vibrating cone attached to the vibrator main body and capable of following the shape of and snugly fitting to the head.

5. A neurological disease prevention apparatus as claimed in claim 1, wherein the neurological disease prevention apparatus further includes:

a music control means for storing therein a plurality of music pieces that can be output from the second vibrators; and a control means for causing the first vibrators and the second vibrators to generate vibration regularly at a prescribed time of day.

6. A neurological disease prevention apparatus as claimed in claim 5, wherein:

the music pieces stored in the music control means include at least a group of Mozart's works consisting of Serenade No. 3 in G Major, K 525 (Eine Kliene Nachtmusik), the first movement of Divertimento No. 1 in D Major, K 136, and No. 3 in B flat Major from 12 German Dances, K 586.

7. A neurological disease prevention apparatus as claimed in claim 1, wherein the neurological disease prevention apparatus further includes:

a wearable unit to be fitted on the head; and snap buttons for attaching the first vibrators and the second vibrators to the inner side of the wearable unit.

8. A neurological disease prevention apparatus as claimed in claim 2, wherein the modulating means is adapted to form the output pulses of pulse vibration energy by modulating the ultrasonic vibration generated by each of the first vibrators with a signal wave, the signal wave being formed in a smooth bell-shaped curve with no change points and having a lower frequency than the ultrasonic vibration.

9. A neurological disease prevention apparatus as claimed in claim 1, wherein the duration of each pulse is less than the duration of each interval.

10. A neurological disease prevention apparatus as claimed in claim 9, wherein the duration of each pulse is 0.1 seconds, and the duration of each interval is 1.5 seconds.

* * * * *